United States Patent [19]

Phinney

[11] 4,072,221

[45] Feb. 7, 1978

[54] MARINE CLUTCH AND THROTTLE GOVERNOR CONTROL SYSTEM

[75] Inventor: John M. Phinney, Milwaukee, Wis.

[73] Assignee: The Falk Corporation, Milwaukee, Wis.

[21] Appl. No.: 715,680

[22] Filed: Aug. 19, 1976

[51] Int. Cl.[2] ..... B60K 29/02

[52] U.S. Cl. ..... 192/.098; 137/596.14; 192/.084

[58] Field of Search ..... 192/.096, .098, .084

[56] References Cited

U.S. PATENT DOCUMENTS

| | | | |
|---|---|---|---|
| 2,524,487 | 10/1950 | Stevens | 192/.098 X |
| 2,580,367 | 12/1951 | Stevens | 192/.098 X |
| 3,727,737 | 4/1973 | Phinney | 192/109 F |

*Primary Examiner*—Benjamin W. Wyche
*Attorney, Agent, or Firm*—Quarles & Brady

[57] ABSTRACT

There is disclosed a control system for the air actuated ahead and astern clutches and the engine speed governor of a marine propulsion system. Upon actuation of a throttle lever controlling a throttle valve, a selector valve is first actuated to operatively connect one or the other of the ahead or astern clutches to the control. Further movement of the throttle lever causes a relay valve to supply air at a pressure proportional to the throttle position to a main control valve which passes such air pressure to the selected clutch until a first control pressure is reached. Thereafter, air from the supply is supplied at a programmed rate to the selected clutch to continue inflation of the clutch until a second control pressure is reached whereupon a boost valve is actuated to connect full supply air pressure to the selected clutch. A governor control valve also receives the air output of the relay valve proportional to throttle position. When the pressure within the selected clutch exceeds the level of a biasing spring within the governor control valve, the governor valve opens and the air output proportional to throttle position is applied to the engine speed governor. Once open, the governor valve is subjected to a counter-biasing pilot pressure equal to its output pressure so that the valve will close whenever the pressure applied to the speed governor plus the biasing pressure of the spring in the governor valve exceeds the pressure of the air within the selected clutch.

12 Claims, 4 Drawing Figures

MARINE CLUTCH AND THROTTLE GOVERNOR CONTROL SYSTEM

BACKGROUND OF THE INVENTION

The invention relates to ship propulsion systems of the type incorporating air actuated clutches, and more specifically to an improved control system which controls both the air supply to the pneumatically operated clutches and the throttle speed of the ship's prime mover.

One form of marine propulsion system employs ahead and astern air actuated clutches for connecting the prime mover to a reversing reduction gear unit for each propeller. In an air actuated clutch, the clutch is engaged by the inflation of an inflatable rubber and fabric air gland bonded to an outer steel rim. Friction lining on the inner surface of the gland engages a cylindrical clutch drum when the gland is inflated. When the gland is fully deflated there is no clutch engagement, and when the gland is fully inflated there is conplete clutch engagement. Between these two extremes the degree of clutch engagement corresponds to the amount of inflation of the gland. In certain propulsion systems the degree of clutch engagement is controlled so that a controlled slip of the clutch is permitted. This allows very low propeller shaft speed; lower than that which would be accomplished at engine idle with full clutch engagement. This is particularly advantageous for maneuvering the ship when docking or traveling in a congested area.

In my earlier U.S. Pat. No. 3,727,737 issued Apr. 17, 1973, for "Pressure Modulating System for Reversing Clutches and Throttle Control", I disclosed a pneumatic clutch control assembly for a ship's propulsion system that was sequentially operated to regulate the inflation of ahead and astern air inflatable clutches and to also control the prime mover speed. The control assembly was actuated by a single throttle lever located on a pilot house control stand. The single lever, if pivoted in either direction from the neutral, supplied air to a selector valve which selected one or the other of the ahead and astern clutches. Thereafter, and up to a first control pressure, air pressure proportional to the position of the lever away from neutral fed through a first valve to the clutch and thereby begin inflating the selected clutch. During this time the engine would remain at idle speed. After a first control pressure was reached, the first valve was piloted and connected a second path for air to the clutch. This second path had provision for an initial programmed rate of feed of air to the clutch through a choke valve so as to softly inflate the clutch. Upon reaching a second higher control pressure, full supply air pressure was connected to the clutch. After the first control pressure was reached, the continued inflation of the clutches was not dependent upon the position of the throttle lever.

When the air pressure within the clutch rose to a predetermined level, the control of my earlier patent piloted a governor valve which, in effect, connected the throttle lever control to the speed governor of the engine so that the pressure supplied to the governor directly corresponded to the position of the throttle lever and the speed could be controlled by movement of the throttle lever.

Accordingly, my earlier control assembly provided for single lever control of both direction and speed. Forward movement of the lever provided forward rotation of a propeller at a speed which increased with handle travel away from neutral. Backward movement of the handle provided astern rotation of the propeller with speed increasing as the handle was moved farther from neutral. The center position provided a neutral setting in which the engine was disconnected from the propeller and no power was transmitted, although the engine continued to idle. The throttle lever determined only the final operating speed and direction and all intermediate steps of clutch engagement and inflation and engine governor speed were handled automatically by the control system.

In my earlier control, once the governor valve controlling the engine governor was actuated by clutch pressure above a certain level, that valve remained actuated until the clutch pressure fell to below that level. This was true regardless of the engine speed once the valve had been actuated. Where the air supply to the system lost pressure for any reason, such as a malfunction in supply, the lower supply pressure would be reflected directly in lower pressure within the clutch. This lower pressure in the clutch might be insufficient to maintain full engagement of the clutch at high engine speed with the result that the clutch could slip at high engine speed.

I have provided by the present invention an improved control system which prevents accidental damage to the clutch due to slippage resulting from reduced air supply pressure. In accordance with my present invention, I have provided a control system which maintains a fixed relationship between the governor signal controlling the speed of the engine and the clutch internal air pressure such that if a normally operating system should begin to lose air pressure, the governor signal will be gradually cut back as the pressure falls thereby automatically reducing engine speed. This will prevent clutch slip, and the lower speed should alert the vessel's operator to the existence of a problem in the air supply.

SUMMARY OF THE INVENTION

In accordance with my invention, I provide a control system for a ship's propulsion system which includes an air activated clutch for connecting a prime mover to a drive train and in which an air pressure signal proportional to a throttle lever position is fed to a governor control valve that is normally closed under the influence of a biasing force, but which can be actuated to open when the pressure within the clutch reaches a level greater than the biasing force. Thereafter the air pressure at the outlet of the governor valve is added to the biasing force so that the governor valve will close whenever the pressure within the clutch is less than the combination of the biasing force and the outlet air pressure.

Further in accordance with my invention, under the conditions of failing clutch pressure the governor valve closes and exhausts to reduce the governor signal to a value not exceeding the internal clutch pressure less the biasing force.

The governor valve may be a double-piloted, diaphragm valve functioning as a regulator valve. The biasing force may be provided by a spring which urges the diaphragm in one direction to have the valve closed, with the clutch pressure connected to a pilot chamber on the opposite side of the diaphragm and the outlet pressure connected to a chamber the same side of the diaphragm as the spring. Once actuated to open, the governor valve will limit its output air pressure to a level proportional to the pressure within the clutch.

It is a principal object of this invention to provide a control system for a pneumatically actuated marine propulsion system in which the engine speed will be automatically reduced as the supply air pressure drops so as to prevent damage to the air actuated clutch connecting the engine to its drive train.

It is another object of the present invention to provide a control system in which a governor control valve for the throttle speed governor of the ship's engine will maintain an air pressure signal to the governor proportional either to a throttle lever position or the pressure within the air actuated clutches connecting the engine to the drive train, whichever results in the lesser signal.

The foregoing and other objects and advantages of the invention will appear in the detailed description which follows. In the description reference is made to the accompanying drawings which illustrate a preferred embodiment of the invention.

DESCRIPTION OF THE PREFERRED EMBODIMENT

Figure 1:
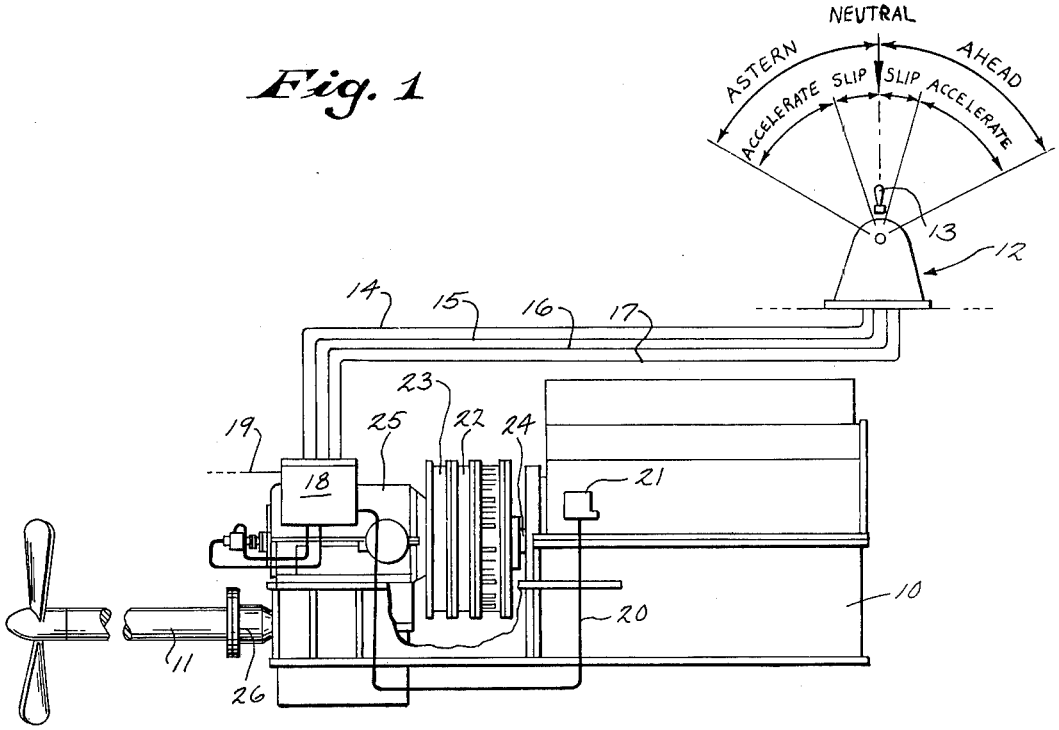
FIG. 1 is a schematic representation of a ship's propulsion system with which the improved control system of a present invention may be employed.

FIG. 1 illustrates a known arrangement of a pneumatically controlled propulsion system of a ship which controls the speed and connection of the ship's engine 10 to the propeller shaft 11. The propulsion system includes a pilot house control stand 12 which mounts a throttle lever 13 controlling a throttle valve (to be described later) which connects four air lines 14, 15, 16 and 17 to a control panel 18.

The control panel assembly 18 is connected to the ship's pressurized air source by a main supply line 19. The panel assembly 18 under control of the throttle lever 2 will function in a manner to be described to regulate a supply of air through a line 20 to a throttle speed governor 21 for the engine 10. The panel assembly 18 will also control the supply of air to an ahead clutch 22 and an astern clutch 23. The clutches 22 and 23 act to transmit torque from the engine 10 connected through a drive shaft 24 to the input of a reverse reduction gear train 25 whose output shaft 26 is connected to the propeller shaft 11. Because the engine 10 is unidirectional and because its output is high in speed but low in torque, the reverse reduction gear train 25 functions to reduce the rotational speed and to increase the torque, and also to reverse the direction of drive when required.

The throttle lever 13 is movable forwardly or rearwardly from a neutral position as indicated in FIG. 1 to select the ship's direction of travel, whereupon supply air is directed to the appropriate astern or ahead clutch 22 and 23. The throttle lever 13 is also movable in an amount to regulate the degree of clutch engagement and thereafter the engine speed.

Figure 2:
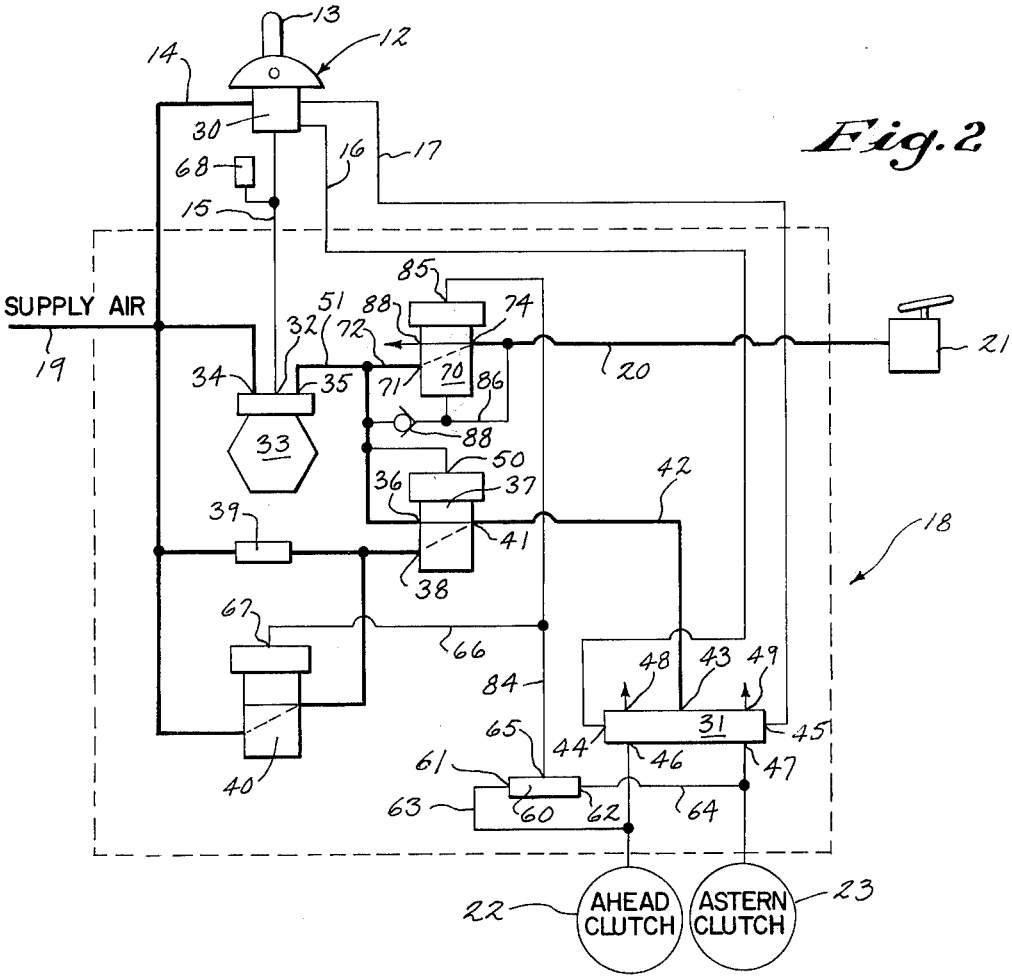
FIG. 2 is a schematic representation of the control system incorporating the present invention and connected to operate the propulsion system of FIG. 1.

Referring to FIG. 2, the throttle lever 13 directly controls a pressure control and directional flow control throttle valve 30. The throttle valve 30 is of known construction and is operative to furnish full supply air pressure from the line 14 which leads from the supply air line 19 to one or the other of the air lines 16 and 17 which function as piloting lines for a clutch selector valve 31. The throttle valve 30 also supplies graduated pressure to the air line 15 and the graduated pressure is always proportional to the degree of movement of the lever 13 away from neutral. The lever 13 is equipped in a known manner with an adjustable friction brake (not shown) that holds the lever in any selected position.

If the lever 13 is pivoted five degrees forward or backward from its neutral position, the throttle valve 30 will function to connect the respective piloting air line 16 or 17 to thereby actuate the four-way selector valve 31 for selection of the appropriate ahead or astern clutch 22 or 23. This movement to select the desired clutch for the desired direction of movement is not sufficient to cause full engagement of the clutches selected. Instead, the initial movement from the neutral position places the propulsion system in a slip operation which means that there is not enough air in the selected clutch to prevent clutch slippage even though the ship's engine 10 is operating at idle throttle speed.

The line 15 whose air pressure is proportional to lever position leads to the pilot port 32 of a relay valve 33 whose inlet port 34 is connected to the supply air line 19 and whose outlet port 35 is connected to the inlet port 36 of a master control valve 37. The relay valve 33 is designed to relay or repeat large quantities of supply air from the supply line 19 to its outlet port 35 at a pressure level corresponding to the air pressure in the piloting line 15. As an example, if air at 15 psi is supplied to the piloting port 32 via the line 15, the pressure level of the air exiting through the outlet port 35 of the relay valve 33 will also equal 15 psi. The relay valve 33 and its connections between the air supply line 19 and the inlet port 36 of the master control valve 37 constitutes a first air branch of the control.

The master control valve 37 has a second inlet port 38 which is connected to a second air branch leading from the air supply line 19. The second branch includes a choke valve 39 and a boost valve 40 connected in parallel across the supply air line 19 and the inlet port 38 of the master control valve 37.

An outlet port 41 of the master control valve 37 connects to a third air branch which comprises an operating line 42 connected to the inlet port 43 of the clutch selector valve 31. The clutch selector valve 31 has two pilot ports 44 and 45 which are connected to the respective piloting lines 16 and 17 leading from the throttle valve 30. The clutch selector valve 31 has a pair of outlet ports 46 and 47 and a pair of exhaust ports 48 and 49. The outlet ports 46 and 47 are connected respectively to the ahead clutch 22 and astern clutch 23.

As previously noted, movement of the throttle lever 13 five degrees forwardly or rearwardly of its neutral position will cause a respective one of the piloting lines 16 and 17 to receive full supply air pressure through the line 14 and will thereby pilot the clutch selector valve to connect a selected one of the outlet ports 46 and 47 with the inlet port 43. Air under pressure will pass through the master control valve 37 and the clutch selector valve 31 to begin to inflate the selected clutch 22 or 23. During the inflation of one of the clutches, the other clutch will be deflated through its corresponding exhaust port 48 or 49. When the control lever 13 is in its neutral position, both clutches 22 and 23 are exhausted to the atmosphere through their respective exhaust ports 48 and 49.

The master control valve 37 is a pneumatic-piloted, pressure sensitive valve that changes the air passages within itself when air at a first control pressure, or higher, is supplied to its piloting port 50. The piloting port 50 is coupled to an operating line 51 which leads from the outlet port of the relay valve 33 to the inlet port 36 of the master control valve 37. Thus, air at the same pressure level is supplied to both the inlet port 36 and the pilot port 50 of the master control valve 37 and this pressure is at the same level as that supplied to the relay valve 33 by the line 15 and is representative of the position of the throttle level 13. So long as the pressure supply through the operating line 51 is less than the piloting pressure which will actuate the master control valve, that pressure will be directed through the master control valve 37 to the operating line 42 and thence to the selected clutch 22 or 23.

When the throttle lever 13 is moved to a position from neutral such that the actuating pressure for the master control valve 37 is exceeded, the master control valve 37 will disconnect the first air branch from the clutches and will instead connect the second air branch to the clutch being controlled. At first, the choke valve 39 will function to permit air to flow from the supply air line 19 through the master control valve 37 and to the operating line 42 at a programmed rate that is determined by the size of the choke valve 39. In this manner, inflation of the selected clutch beyond the first control pressure is initially controlled by this choke valve 39 so that the clutch is not abruptly fully inflated but is instead inflated in a controlled and soft manner. There is no flow of air through the boost valve 40 at this time because the boost valve 40 is normally closed and will not open until piloted by the air pressure within the clutch.

The air pressure that controls the piloting of the boost valve 40 is provided by a piloting circuit comprised of a shuttle valve 60 which has a pair of inlet ports 61 and 62 connected by piloting lines 63 and 64, respectively, to the supply lines for the ahead and astern clutches 22 and 23, respectively. The shuttle valve 60 has a single outlet port 65 which is connected via a piloting line 66 to the pilot port 67 of the boost valve 40. The shuttle valve 60 automatically selects and directs the flow of air from the respective one of the clutches 22 and 23 which is being engaged. It will connect either but not both of its inlet ports 61 or 62 with its outlet port 65. Thus, air is siphoned from the clutch 22 or 23 which is at the highest pressure and is supplied to the pilot port 67 of the boost valve 40. When the air pressure thus supplied, and consequently the air pressure within the inflating clutch, reaches a second control pressure at which the boost valve 40 is set to be piloted, that valve will open to connect the supply air line 19 to the inlet port 38 of the master control valve 37 thereby bypassing the choke valve 39. When this occurs, full supply air pressure is supplied to the operating line 42 and clutch selector valve 31 so that the selected clutch 22 or 23 will be fully inflated.

To summarize the operation of the control as thus far described, up to a first control pressure which is directly proportional to the movement of the throttle lever 13, air pressure proportional to the lever position feeds through the master control valve 37 to the selected clutch. After that first control pressure is reached, which is the piloting pressure for the master control valve 37, air pressure is fed at a programmed rate through the choke valve 39 to the selected clutch without regard to the continued motion of the control lever 13. After a second control pressure is reached, which is the piloting pressure for the boost valve 40, air at full supply pressure is fed to the selected clutch through the boost valve 40 and the clutch is fully inflated. To deflate, the throttle lever 13 is returned to its neutral position which will cause the selector valve 31 to connect the exhaust ports to the clutches 22 and 23. Air is exhausted from the control line 15 by a bleeder valve 68.

What has been described thus far does not differ from the control system disclosed in my earlier U.S. Pat. No. 3,727,737.

The components thus far described are those which are employed to provide the controlled rate of inflation of the clutches 22 and 23. The control panel assembly 18 also controls the throttle speed governor 21 through the vehicle of a double-piloted throttle governor valve 70. The throttle governor valve 70 has an inlet port 71 connected by a line 72 to the line 51 leading from the outlet port 35 of the relay valve 33. An outlet port 74 of the throttle governor valve 70 is connected to the operating line 20 for the throttle speed governor 21. Since the inlet port 71 is connected to the outlet of the relay valve 33, the governor valve 70 will be provided with air under pressure proportional to the position of the throttle lever 13. The throttle governor valve 70 is normally closed, but when piloted to open, it will pass the air pressure proportional to throttle lever position into the line 20 and to the throttle speed governor 21, thereby controlling the speed of the engine 10.

Figure 3:
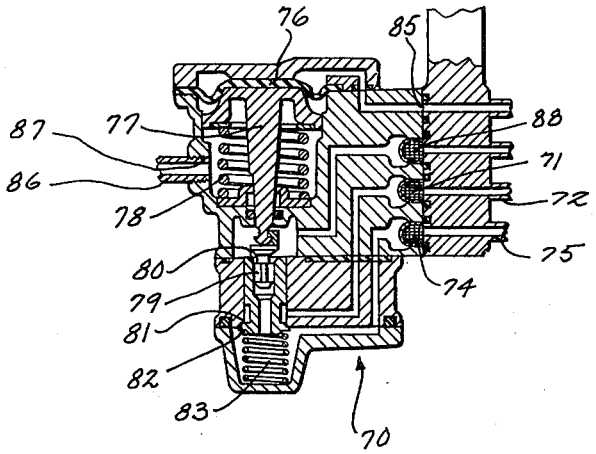
FIG. 3 is a detailed view in section of a governor control valve used in the control system of the invention.

Referring to FIG. 3 in which the details of construction of the governor valve 70 are shown, the valve 70 is a known form of commercially available diaphragm valve. The valve diaphragm 76 is operately connected to a diaphragm follower 77 which is normally urged upwardly by a spring 78 to close the valve. Attached to the bottom of the follower 77 is an exhaust valve 79 which operates against a valve seat 80 formed at one end of a supply valve 81. The supply valve 81 operates against a supply valve seat 82 and is normally biased upwardly into a position against the seat 82 by a supply valve spring 83. A first pilot line 84 leads from the shuttle valve outlet port 65 to a pilot port 85 connected to a chamber above the diaphragm 76. A second pilot line 86 leads from the throttle speed governor operating line 20 to a second pilot port 87 which in turn is connected to a chamber beneath the diaphragm 76. The pilot line 86 is connected through a check valve 88 to the outlet of the relay valve 33 and consequently to the line 72 which supplies the inlet port 71 of the governor valve 70. The throttle governor valve also includes an exhaust port 88 which is vented to the atmosphere.

In the position illustrated in FIG. 3, the valve is closed. If pressure admitted through the upper pilot port 85 from the shuttle valve 65 is sufficient to initially overcome the force of the spring 78, the diaphragm 76 and its follower 77 move downward, compressing the spring 78 and seating the exhaust valve 79 on the seat 80 formed on top of the supply valve 81. As downward movement continues, the supply valve 81 moves away from its seat 82 and compresses the supply valve spring 83. The first movement closes the exhaust port 88 and the continued movement connects the inlet port 71 with the outlet port 74. The throttle governor valve 70 is now open and an air pressure signal proportional to the position of the throttle lever 13 will pass from the inlet port 71 to the outlet port 74 and thence to the engine speed governor 21. In this manner the engine speed will be controlled by varying the throttle lever 13 position to vary the air pressure signal.

The pressure at which the governor valve 70 is actuated is determined by selecting the spring force operating against the diaphragm 76. Once the valve 70 has been opened, a counter-biasing piloting pressure is exerted on the underside of the diaphragm 76 which is added to the force of the spring 78 and which must be overcome by the piloting pressure. This reverse bias pressure is equal to the air pressure which is being transmitted through the governor valve 70 to the throttle speed governor 21. That is, once the valve 70 has opened, the actual air pressure within the selected clutch must exceed the governor signal pressure plus the force of the spring 78. This is the principal feature of the present invention.

If supply air pressure in the line 19 is lost for any reason such as dirt or contaminations in the line, or a leak, the maximum governor signal which is allowed to be transmitted to the line 75 and thus to the throttle speed governor 21 will be reduced in proportion to the falling clutch pressure. This prevents inadvertent and unanticipated clutch slippage which, if not noted and corrected immediately, could result in the clutch burning out and the propulsion system being damaged.

As soon as the pressure within the selected clutch falls to the level of the speed signal pressure in the operating line 20 plus the force of the spring 78, the diaphragm follower will move up. This will initially cause the supply valve 81 to close thereby disconnecting the operating line 20 from the relay valve 33. If the pressure then stabilizes at the balanced condition, the follower 77 will not move further and the exhaust valve 79 will remain closed. If the clutch pressure drops beneath the combined counter-biasing forces, the exhaust valve 79 will also open to connect the operating line 20 to the exhaust port 88 to thereby lower the pressure until the combination of the speed signal pressure and the spring force equal the internal clutch pressure, at which time both the exhaust valve 79 and supply valve 81 will be closed. If the clutch pressure changes up or down the speed signal pressure will be changed proportionally without a change in throttle lever position. If the throttle lever 13 is thereafter moved to reduce the engine speed, the lower pressure which will result in the lines 51 and 72 will be matched in the operating line 20 by having the operating line 20 vent through the check valve 88.

Figure 4:
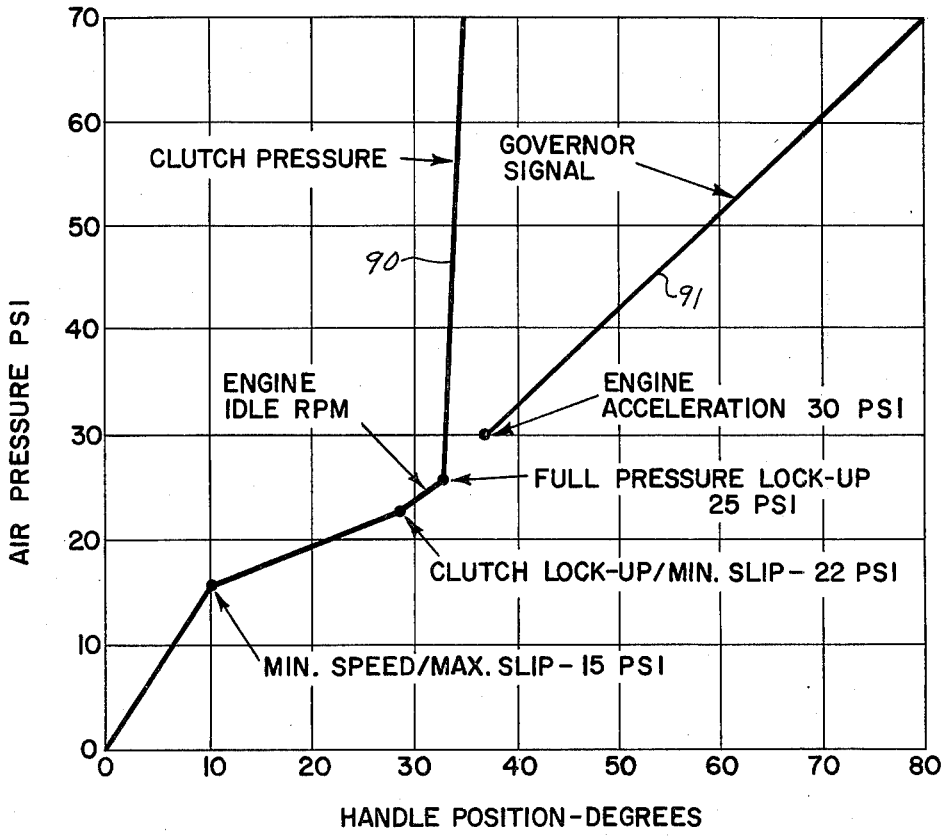
FIG. 4 is a graphical representation of the operation of a system constructed in accordance with the present invention.

An example of the operation of the system in accordance with the present invention is illustrated by the graphical representations of FIG. 4. In FIG. 4, there are two curves shown. A first curve 90 illustrates the change in the air pressure within the selected clutch in relation to the position of the throttle lever 13 away from neutral. The second curve 91 illustrates the relationship between the air pressure of the governor's signal being transmitted through the line 20 to the throttle speed governor 21, again in relation to the lever position. The graph of FIG. 4 is for a system which utilizes air from the ship's compressed air supply at 140 psi normal and at a minimum of 125 psi. The master control valve 37 is set to be piloted at a pressure of 25 psi and the relay valve 33 is adjusted to provide a range of from 0 to 70 psi in output pressure. The boost valve 40 is adjusted to be piloted at a clutch pressure of 70 psi while the throttle governor valve 70 is adjusted to be piloted at a clutch pressure of 45 psi.

When the throttle lever 13 is moved five degrees out of neutral, either ahead or astern, the four-way selector valve 31 will shift thereby selecting either the ahead or astern clutch 22 or 23, respectively, which is then connected to receive air through the valve 31. The control is adjusted to begin clutch engagement and to obtain a maximum slip at a 10° handle position which will correspond to a 15 psi pressure passing through the relay valve 33, the master control valve 37, and the selector valve 31 to the selected clutch. At this time the engine is idling, and since the maximum slip is provided, the slowest propeller speed will result. As the throttle lever 13 continues to be moved away from neutral, air pressure proportional to the position of the lever 13 will be fed to the selected clutch until at about 22 psi minimum slip of the clutch with the engine idling will result. When the pressure through the relay valve 33 increases to 25 psi, the master control valve 37 will be piloted thereby closing the connection between the relay valve 33 and the clutch selector valve 31 and replacing it with the connection through the choke valve 39. This occurs at about a 30° handle position. Thereafter, the inflation of the selected clutch is controlled by the choke valve 39 and not by continued movement of the throttle lever 13. For a clutch pressure between 25 to 70 psi supply air is passed to the selected clutch through the choke valve 39 for a soft clutch engagement. When clutch pressure reaches 70 psi, the boost valve 40 shifts to bypass the choke valve 39 and directly connects the clutch to the supply air line 19. The boost valve actuating pressure is determined by the clutch air pressure needed for full clutch engagement at engine idle speed.

During this same time if the lever handle 13 continues to be moved through an arc until it is moved into a position of about 40°, the lever 13 will be controlling the speed signal to the engine governor to control engine acceleration from idle to full speed. That is, when the handle is at a position initially to select a speed signal of 30 psi, and if the clutch has been inflated to an internal pressure of 45 psi or more so that the governor valve 70 has opened, the speed signal directed to the throttle speed governor 21 will increase in proportion to the movement of the throttle lever 13 up to a maximum signal pressure of 70 psi and the engine speed will increase.

If supply air pressure is lost or lowered for any reason, the maximum governor speed signal will be reduced in proportion to the falling clutch pressure. For example, if the supply pressure should fall to 110 psi, such reduced supply pressure will result in a reduction in the internal clutch pressure in the same amount. This internal clutch pressure is being applied to the top of the diaphragm of the governor valve 70, and if the speed signal pressure is at its maximum 70 psi at that time, the upward force operating on the diaphragm 76 will be equal to 115 psi (70 psi signal pressure plus the force of the spring 78). Since the biasing pressure is greater than the piloting pressure the governor valve 70 will function as previously described so that the pressure within the operating line 20 for the throttle speed governor 21 will be reduced to a level of 65 psi where it, combined with the force of the spring 78, will be the same as the internal pressure in the clutch. Accordingly, the lower signal pressure in the line 20 will cause lowering of the speed of the engine and will prevent inadvertent clutch slippage. If the supply pressure as reflected in the internal pressure in the selected clutch should fall to 75 psi, the supply valve 81 of the governor valve 70 will close and the exhaust valve 79 will open until the speed signal pressure is reduced to 30 psi. The combination of the lowest speed signal pressure of 30 psi and the spring pressure of 45 psi will be sufficient to hold the governor valve in its normal closed state, and this will not permit the engine to run above its idle speed. At any intermediate pressure, full control would be available below the limiting speed established by the internal clutch pressure.

I claim:

1. A pneumatic clutch control system for a marine propulsion drive including a prime mover controlled by a throttle speed governor, a drive train for transmitting power from the prime mover to a propeller drive shaft, an air inflatable clutch for connecting the prime mover to said drive train, and throttle means for actuation of the propulsion system, said control system being adapted for connection to a source of pressurized air and comprising:

first and second air branches each leading from said air source to a main control valve which is shiftable to connect one or the other of said air branches to said clutch, said first air branch including means operatively connected to said throttle means to provide an air output that is responsive to air pressure supplied to said first branch by said throttle means;

said main control valve being responsive to the air output from said first branch to disconnect said first branch and connect said second branch to said clutch when said air output reaches a first control pressure;

said second air branch continuing the inflation of said clutch without further control of said throttle means; and a throttle governor control means connected to receive the air output of said first air branch and for providing a speed pressure signal to said throttle speed governor which is proportional to said air output, said governor control means comprising a normally closed governor valve responsive to the air pressure in said clutch and adapted to be actuated to connect said first air branch to said governor when the clutch pressure rises to a first piloting pressure, said governor valve being further responsive to said speed pressure signal to have said speed pressure signal oppose the clutch pressure so that said governor valve will close when clutch pressure is less than the combination of said speed pressure signal and said first piloting pressure.

2. A control system in accordance with claim 1 wherein:

said governor valve is a diaphragm valve having an inlet port connected to said first air branch and an outlet port connected by an operating line to said governor, a spring is disposed to one side of said diaphragm and the force of said spring establishes said first piloting pressure, a pilot line leads from said clutch to a pilot port on the other side of said diaphragm, and a second pilot line leads from said operating line to a pilot port on said one side of said diaphragm.

3. A control system in accordance with claim 2, together with a check valve disposed in a connection between said second pilot line and said first air branch, said check valve arranged to block flow from said first air branch to said second pilot line and to pass flow in the opposite direction.

4. In a pneumatic clutch control system for a marine propulsion system having a prime mover controlled by a throttle speed governor, a drive train for transmitting power from the prime mover to a propeller drive shaft, ahead and astern air inflatable clutches for selectively connecting the prime mover to said drive train, and throttle means for actuation of the propulsion system, and wherein said control system is adapted for connection to a source of pressurized air and includes a selector valve responsive to movement from neutral of the throttle means to select one or the other of said ahead and astern clutches, inflation means for inflating the selected clutch by first providing air pressure proportional to movement of the throttle means from neutral up to a first control pressure following which the clutch is inflated at a programmed rate up to full air pressure without further movement of the throttle means, said inflation means including a first valve responsive to said throttle means and connected to said air supply to provide an air output at a pressure proportional to throttle position, the combination therewith of:

a governor control valve connected to receive the air output of said first valve and adapted, when open, to pass such air output to said throttle speed governor, said governor control valve being biased to a closed position and being connected to receive a first piloting signal which represents the internal pressure of the selected clutch and which piloting pressure works against the bias to open said valve when the pressure within the selected clutch exceeds the bias force, and said valve being connected to receive a second piloting pressure which is representative of the air pressure passed to said governor and which second piloting pressure opposes the first piloting pressure and is additive of the biasing force.

5. A pneumatic clutch control system in accordance with claim 4 wherein said governor control valve has an inlet port connected to said first valve, an outlet port connected to said governor, and an exhaust port, said governor valve including a normally closed supply valve which blocks the inlet port from the outlet port and a normally opened exhaust valve, said exhaust valve being closed when said governor valve is actuated by said first piloting pressure to block the outlet port from communication with said exhaust port after which said supply valve opens.

6. In a pneumatic clutch control system for a marine propulsion drive which includes a prime mover controlled by a throttle speed governor, a drive train for transmitting power from the prime mover to a propeller drive shaft, an air inflatable clutch for connecting the prime mover to said drive train, and throttle means for actuation of the propulsion system, and wherein said control system is adapted for connection to a source of pressurized air and includes means responsive to the throttle means and connected to the air source to provide an air output at a pressure determined by said throttle means, the combination therewith of:

throttle governor control means connected to receive said air output and for providing a speed pressure signal to said throttle speed governor which is proportional to said air output, said governor control means comprising a normally closed governor valve responsive to the air pressure in said clutch and adapted to be actuated to connect said air output to said governor when the clutch pressure rises to a first piloting pressure, said governor valve being further responsive to said speed pressure signal to have said speed pressure signal oppose the clutch pressure so that said governor valve will close when clutch pressure is less than the combination of said speed pressure signal and said first piloting pressure.

7. A control system in accordance with claim 6 wherein:

said governor valve is a diaphragm valve having an inlet port connected to receive said air output and an outlet port connected by an operating line to said governor, a spring is disposed to one side of said diaphragm and the force of said spring establishes said first piloting pressure, a pilot line leads from said clutch to a pilot port on the other side of said diaphragm, and a second pilot line leads from said operating line to a pilot port on said one side of said diaphragm.

8. A control system in accordance with claim 7, together with a check valve disposed between said second pilot line and the connection to said inlet port, said check valve arranged to block the flow of said air output to said second pilot line and to pass flow in the opposite direction.

9. In a pneumatic clutch control system for a marine propulsion system having a prime mover controlled by a throttle speed governor, a drive train for transmitting power from the prime mover to a propeller drive shaft, an air inflatable clutch for selectively connecting the prime mover to said drive train, and throttle means for actuation of the propulsion system, and wherein said control system is adapted for connection to a source of pressurized air and includes inflation means for inflating said clutch by first providing air pressure proportional to movement of the throttle means from neutral up to a first control pressure following which the clutch is inflated at a programmed rate up to full air pressure without further movement of the throttle means, said inflation means including a first valve responsive to said throttle means and connected to said air supply to provide an air output at a pressure proportional to throttle position, the combination therewith of:

a governor control valve connected to receive the air output of said first valve and adapted, when open, to pass such air output to said throttle speed governor, said governor control valve being biased to a closed position and being connected to receive a first piloting signal which represents the internal pressure of said clutch and which piloting pressure works against the bias to open said valve when the pressure within said clutch exceeds the bias force, and said valve being connected to receive a second piloting pressure which is representative of the air pressure passed to said governor and which second piloting pressure opposes the first piloting pressure and is additive of the biasing force.

10. A pneumatic clutch control system in accordance with claim 9 wherein said governor control valve has an inlet port connected to said first valve, an outlet port connected to said governor, and an exhaust port, said governor valve including a normally closed supply valve which blocks the inlet port from the outlet port and a normally opened exhaust valve, said exhaust valve being closed when said governor valve is actuated by said first piloting pressure to block the outlet port from communication with said exhaust port after which said supply valve opens.

11. In a pneumatic clutch control system for a marine propulsion system having a prime mover controlled by a throttle speed governor, a drive train for transmitting power from the prime mover to a propeller drive shaft, ahead and astern air inflatable clutches for selectively connecting the prime mover to said drive train, and throttle means for actuation of the propulsion system, and wherein said control system is adapted for connection to a source of pressurized air and includes a selector valve responsive to movement from neutral of the throttle means to select one or the other of said ahead and astern clutches, and means responsive to said throttle means and connected to said air supply to provide an air output at a pressure proportional to throttle position, the combination therewith of:

a governor control valve connected to receive said air output and adapted, when open, to pass such air output to said throttle speed governor, said governor control valve being biased to a closed position and being connected to receive a first piloting signal which represents the internal pressure of the selected clutch and which piloting pressure works against the bias to open said valve when the pressure within the selected clutch exceeds the bias force, and said valve being connected to receive a second piloting pressure which is representative of the air pressure passed to said governor and which second piloting pressure opposes the first piloting pressure and is additive of the biasing force.

12. A pneumatic clutch control system in accordance with claim 11 wherein said governor control valve has an inlet port connected to receive said air output, an outlet port connected to said governor, and an exhaust port, said governor valve including a normally closed supply valve which blocks the inlet port from the outlet port and a normally opened exhaust valve, said exhaust valve being closed when said governor valve is actuated by said first piloting pressure to block the outlet port from communication with said exhaust port after which said supply valve opens.

* * * * *